US009382759B2

(12) United States Patent
Bolinski et al.

(10) Patent No.: US 9,382,759 B2
(45) Date of Patent: Jul. 5, 2016

(54) CABLE HOOK ATTACHMENT FOR LADDERS

(71) Applicant: Eric C. Bolinski, Austin, MN (US)

(72) Inventors: Eric C. Bolinski, Austin, MN (US); Richard B. Stoner, Big Prairie, OH (US)

(73) Assignee: Eric C. Bolinski, Austin, MN (US)

( * ) Notice: Subject to any disclaimer, the term of this patent is extended or adjusted under 35 U.S.C. 154(b) by 0 days.

(21) Appl. No.: 14/305,219

(22) Filed: Jun. 16, 2014

(65) Prior Publication Data

US 2014/0367194 A1 Dec. 18, 2014

Related U.S. Application Data

(60) Provisional application No. 61/836,305, filed on Jun. 18, 2013.

(51) Int. Cl.
*E06C 7/18* (2006.01)
*E06C 7/48* (2006.01)

(52) U.S. Cl.
CPC .. *E06C 7/188* (2013.01); *E06C 7/48* (2013.01)

(58) Field of Classification Search
CPC ..... E06C 1/36; E06C 7/50; E06C 7/505; E06C 7/18; E06C 7/182; E06C 7/188; E06C 7/488; E06C 7/486; E06C 7/42; E06C 7/48
See application file for complete search history.

(56) References Cited

U.S. PATENT DOCUMENTS 651,665 A * 6/1900 Johns ..... 182/103
675,545 A * 6/1901 Hatch ..... 248/691
1,205,594 A * 11/1916 Close ..... 182/206
1,386,511 A * 8/1921 Krahl ..... 182/129
2,797,038 A * 6/1957 Tiberghien ..... 182/210
3,590,951 A * 7/1971 Berger ..... 182/206
4,089,390 A * 5/1978 McLain ..... 182/206
4,311,209 A * 1/1982 Primerano et al. ..... 182/206
4,425,985 A * 1/1984 Geisel et al. ..... 182/121
4,646,878 A * 3/1987 Moyer ..... 182/121
5,054,581 A * 10/1991 Henson ..... 182/206
5,429,207 A * 7/1995 Frank et al. ..... 182/209
5,601,154 A * 2/1997 Eisenmenger ..... 182/45

(Continued)

OTHER PUBLICATIONS

Little Giant Safety; Aerial Safety Cage 8'-14' Tip and Glide Wheels; http://littlegiantsafety.com/videos; Sep. 10, 2014.

(Continued)

*Primary Examiner* — Katherine Mitchell
*Assistant Examiner* — Shiref Mekhaeil
(74) *Attorney, Agent, or Firm* — Zarley Law Firm, P.L.C.

(57) ABSTRACT

A fixed strand grabber and a removable strand grabber are presented for use on a conventional ladder. The strand grabber includes a hook member connected to a top support and a bottom lever. The bottom lever has a portion that extends past and encloses the open interior of the hook that protrudes from the forward side of the ladder. As the ladder is lowered over a cable, the hooks move upward which in turn causes the bottom lever to rotate upward. A portion of the bottom lever encloses the open interior of the hook thereby locking the cable therein. In this way improved safety is provided as the cable is prevented from accidently slipping out of the open interior of the hook which improves user safety. The system also provides an attachment point for a safety lock. In addition, the removable strand grabber provides a V-brace for using against utility poles.

14 Claims, 9 Drawing Sheets

(56) References Cited

U.S. PATENT DOCUMENTS

| | | | | |
|---|---|---|---|---|
| 6,044,930 | A * | 4/2000 | Hayman | 182/206 |
| 7,004,288 | B2 * | 2/2006 | Araki et al. | 182/103 |
| 7,219,766 | B2 * | 5/2007 | Deuer | 182/206 |
| 8,074,769 | B2 * | 12/2011 | Sracic et al. | 182/103 |
| 8,752,254 | B2 * | 6/2014 | Perner | 24/599.5 |
| 8,776,947 | B1 * | 7/2014 | Wurth et al. | 182/1 |
| 8,974,137 | B2 * | 3/2015 | Parker et al. | 403/322.3 |
| 2005/0169703 | A1 * | 8/2005 | Fatemi | 403/321 |
| 2009/0020360 | A1 * | 1/2009 | May | 182/1 |
| 2010/0326768 | A1 * | 12/2010 | Kerstetter, Jr. | 182/5 |
| 2011/0175385 | A1 * | 7/2011 | Buie et al. | 294/82.2 |
| 2012/0210542 | A1 * | 8/2012 | Yang | 24/369 |
| 2012/0247869 | A1 * | 10/2012 | Anderson | 182/8 |
| 2014/0102827 | A1 * | 4/2014 | Russell et al. | 182/107 |
| 2015/0075905 | A1 * | 3/2015 | Ballard et al. | 182/107 |
| 2015/0075907 | A1 * | 3/2015 | Moss et al. | 182/129 |

OTHER PUBLICATIONS

Stephen Whyte Strategic Connections, LLC; "Advancements in Ladder Design by Little Giant Ladder Systems Increase Workplace Safety"; http://littlegiantsafety.com/press/view/?id=17; Sep. 10, 2014; Little Giant Ladder Systems website.

* cited by examiner

CABLE HOOK ATTACHMENT FOR LADDERS

CROSS REFERENCE TO RELATED APPLICATION

This application claims the benefit of U.S. Provisional Application No. 61/836,305 filed Jun. 18, 2013.

FIELD OF THE INVENTION

This invention relates to a cable hook. More specifically, and without limitation, this invention relates to a cable hook attachment for ladders.

BACKGROUND OF INVENTION

Ladders are old and well known in the art. Conventional ladders have a pair of laterally extending side rails that extend in parallel spaced relation to one another a distance. A plurality of transverse rungs extend across and between connecting the opposing side rails. Ladders are often used by placing one end of the ladder on the ground and positioning the opposite end on the side of a building or structure such that the ladder extends upwardly at an angle. In this position, a user climbs the ladder by grasping the rungs and/or the side rails while incrementally stepping on the rungs. In this way ladders are used to access areas high above the ground and far outside of a user's reach.

Because ladders are used to provide access high above the ground, safety is a preeminent issue. Many devices and methods have been developed to help ensure that a ladder and/or a user does not slip or fall when positioned high above the ground.

One particularly treacherous situation includes when a ladder is used by propping it up against a wire, cord or cable which is stretched in space such as a telephone cable, power line or the like (collectively referred hereinafter as "cable"). This situation is particularly dangerous because the cable is dynamic in nature. That is, the cable can move, sway, stretch or slip thereby providing additional slack or movement. This can cause the ladder to move, fall slip or slide itself.

To resolve this problem, cable hook attachments have been designed which comprise a simple hook or pair of hooks that extend from the end of the ladder. While somewhat useful, these cable hooks allow the ladder to slide along the cable. In addition, there is no mechanism holding the cable within the hook other than the force of gravity. In addition, these cable hooks have a tendency to get in the user's way when not in use and therefor pose a safety problem.

One attempt at a solution to these problems is the Little Giant Claw manufactured by Wing Enterprises, Incorporated Corporation, of 1198 North Spring Creek Place Springville Utah 84663. The Little Giant Claw system has a pair of hooks, and a pair of rotating brackets that are connected to one another by a cross bracket. Because the cross bracket extends across the width of the ladder, this requires the Little Giant Claw to be placed exclusively on the top of the ladder. In addition, when engaged, this cross bracket is in the primary operating space of the user which is hazardous and reduces the utility of the device. Furthermore this device is heavy and bulky, which are substantial problems when a device is used in association with a ladder and is used high above the ground.

For the reasons stated above, and for other reasons stated below which will become apparent to those skilled in the art upon reading and understanding the specification and reviewing the drawings, there is a need in the art for an improved cable hook ladder attachment.

Thus it is a primary object of the invention to provide a cable hook ladder attachment that improves upon the state of the art.

Another object of the invention is to provide a cable hook ladder attachment that is inexpensive.

Yet another object of the invention is to provide a cable hook ladder attachment that improves safety.

Another object of the invention is to provide a cable hook ladder attachment that has a minimum number of parts.

Yet another object of the invention is to provide a cable hook ladder attachment that has an intuitive design.

Another object of the invention is to provide a cable hook ladder attachment that is safer to operate than prior devices because it does not get in the user's way when in operation.

Yet another object of the invention is to provide a cable hook ladder attachment that is both permanently attachable as well as removable.

Another object of the invention is to provide a cable hook ladder attachment that is efficient to use.

Yet another object of the invention is to provide a cable hook ladder attachment that is rugged and durable.

Another object of the invention is to provide a cable hook ladder attachment that is easily used.

Yet another object of the invention is to provide a cable hook ladder attachment that is light weight.

Another object of the invention is to provide a cable hook ladder attachment that has hooks that are independently engaged.

Yet another object of the invention is to provide a cable hook ladder attachment that can be attached at various positions along the length of a ladder and not exclusively at the top of a ladder.

These and other objects, features and advantages will become apparent from the description, drawings and the claims

SUMMARY OF THE INVENTION

A fixed strand grabber and a removable strand grabber are presented for use on a conventional ladder. The strand grabber includes a hook member connected to a top pivoting arm or other support and a bottom lever. The bottom lever has a portion that extends past and encloses the open interior of the hook. The hook protrudes from the forward side of a ladder. As the ladder is lowered over a cable, the cable causes the hook to move upward which in turn causes the bottom lever to rotate upward. A portion of the bottom lever encloses the open interior of the hook thereby locking the cable therein. In this way improved safety is provided as the cable is prevented from accidently slipping out of the open interior of the hook which improves user safety. The system also provides an attachment point for a safety lock. In addition, the removable strand grabber provides a V-brace for using against utility poles.

DETAILED DESCRIPTION OF THE INVENTION

Figure 1:
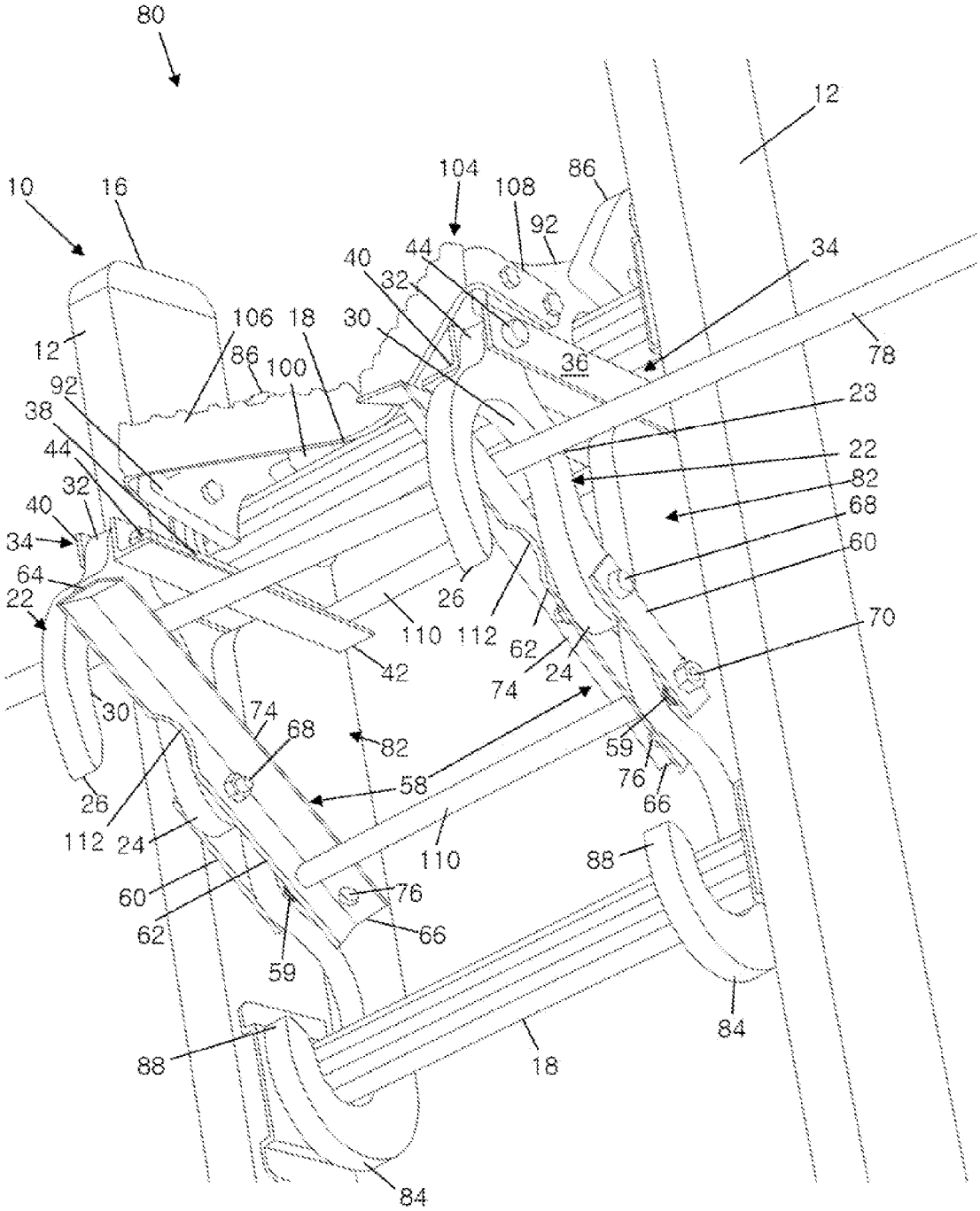
FIG. 1 is a perspective view one side of a removable strand grabber connected to a conventional ladder, the removable strand grabber positioned in an engaged position on a cable.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the present inventions. The following detailed description is, therefore, not to be taken in a limiting sense, and the scope of the present invention is defined only by the appended claims, along with the full scope of equivalents to which such claims are entitled.

As used herein, the terminology such as vertical, horizontal, top, bottom, front, back, ends, sides, etc., are referenced according to the views presented. It should be understood, however, that the terms are used only for purposes of description, and are not intended to be used as limitations. Accordingly, orientation of an object or a combination of objects may change without departing from the scope of the invention.

With reference to the figures, a conventional ladder 10 is presented. The ladder includes a pair of side rails 12 which extend a length between a bottom end (not shown) and an upper end 16. A plurality of rungs 18 are connected to and extend between the interior sides of side rails 12. In one arrangement, the rungs 18 have a generally D-Shaped profile. That is, when viewed from the side, rungs 18 have a flat top surface which provides a large flat surface area for a user to step on, while the remaining portion of the rung is arcuate or curved to provide strength and rigidity.

Fixed Strand Grabber: With reference to FIGS. 3-8, a fixed strand grabber 20 is presented. The fixed strand grabber 20 has a pair of opposing sides which are for all intents and purposes mirror one another. Each side includes a hook 22. Hook 22 is formed of any suitable size, shape and design. In one arrangement, hook 22 arcuately curves between a base 24 and a tip 26 thereby defining a convex exterior surface 28 and a concave interior surface 30. The hook 22 is generally aligned such that the open interior defined between the concave interior surface 30 faces downward so as to hook over a cable when in use.

A connecting tab 32 extends outwardly from the convex exterior surface 28 and has a through hole therein. Connecting tab 32 can be positioned along any portion of convex exterior surface or alternatively, connecting tab 32 is omitted and the hole in connecting tab 32 is positioned in the hook 22 itself. As another alternative, connecting tab 32 and hole therein can be omitted and hook may be connected to top support 34 by any other suitable means. As one example, in the arrangement shown, connecting tab 32 protrudes from the upper surface of the convex exterior surface 28 and is slightly positioned towards the rear of hook 22. Connecting tab 32 and its corresponding through hole serves for mounting of hook 22 to other components of the system as is described more fully herein.

Similarly, a through hole is also positioned in hook 22 adjacent the base 24. This through hole also serves for mounting of hook 22 to other components of the system as is described more fully herein.

A top support 34 is connected to connecting tab 32. Top support 34 is formed of any suitable size shape and design. In one arrangement, top support 34 is formed by a flexible cord or cable, which extends a distance between a forward end 40 and a rearward end 42. Forward end 40 connects to hook 22 at connecting tab 32 whereas rearward end 42 connects to the side rail 12. This support serves to help the hook 22 maintain the correct orientation in relation to the ladder 10 and other components of the system. Alternately, this support 34 may be wrapped around or clipped to another component of the ladder by means of a permanent or removable clip 43 connected to one or both ends 40, 42. In the arrangement shown, clip 43 connects to a loop 43A connected to side rail 12 of ladder 10. A second loop 43B is connected to the ladder 10 below strand grabber 20. When strand grabber 20 is not in use, clip 43 may be disconnected from upper loop 43A. This will permit hook 22 to be rotated into an upside down, rear facing position and to be secured in that position by connecting clip 43 to lower loop 43B. This will be advantageous in any situation wherein the strand grabber is not being used and the normal disengaged position of fixed strand grabber 20 interferes with the way the ladder is being used at that time.

While the use of a flexible top support 34 provides advantages, one disadvantage is that the use of a flexible top support 34 does not prevent the hook 22 from over rotating, or rotating past a fully upward position. To cure this problem the system includes a back stop 21 that extends outwardly from side rail 12 of ladder 10, or any other portion of the system, and prevents the hook 22 from rotating backward beyond a desired position. Any suitable form, shape or design of back stop 21 may be formed of any suitable size, shape and design and may include objects as a bolt, ladder rung, handle, protrusion, bracket or the like.

In an alternate arrangement, as is shown, top support 34 is formed of a rigid exterior plate 36 and a rigid interior plate 38 which are positioned in parallel spaced relation to one another. The exterior plate 36 is positioned on the exterior side of hook 22, and the interior plate 38 is positioned on the interior side of hook 22. In this way, the parallel spaced positioning of exterior plate 36 and interior plate 38 sandwich or hold hook 22 there between. Exterior plate 36 and interior plate 38 extend a distance between a forward end 40 and a rearward end 42.

A first axle 44 extends through the exterior plate 36 and interior plate 38 adjacent the forward end 40. First axle 44 also extends through one or more spacers 53 and connecting tab 32 of hook 22 thereby connecting hook 22 to the exterior plate 36 and interior plate 38 together while still allowing rotation of hook 22 within the exterior plate 36 and interior plate 38. Spacers 53 are formed by one or more washers, bushings or other suitable devices.

Similarly, second axle 46 extends through the exterior plate 36 and interior plate 38 adjacent the rearward end 42. This axle 44 also extends through or is connected to a mounting bracket 48. First axle 44 and second axle 46 may include a spacer positioned between opposing ends to provide proper spacing of the exterior plate 36 and interior plate 38.

Mounting bracket 48 is formed of any suitable size, shape or design. In one arrangement, as is shown, mounting bracket 48 is formed of a generally flat, generally rectangular mounting plate 50 which is installed flush against the interior surface of the side rail 12 of ladder 10. To facilitate mounting of the mounting bracket 48 to the side rail 12 one or more mounting holes are positioned in any portion of mounting plate 50, and in the arrangement shown in FIG. 3, one is positioned in each corner of the generally rectangular mounting plate. Conventional fasteners 52, such as bolts, screws, rivets, are used to connect mounting bracket 48 to the ladder 10. Alternatively, the components are formed together or alternatively they are connected by any other means such as welding, a snap-fit arrangement or the like. A mounting tab 54 is connected to mounting plate 50. When mounting plate 50 is flush with the side rail 12 of ladder 10, mounting tab 54 is positioned a distance away from side rail 12 to provide proper spacing and facilitate rotation of second axle 46. That is, mounting bracket 48 has a curved, bent or arcuate portion 56 which extends upwardly away from side rail 12 and mounting plate 50 to connect mounting tab 54 to the mounting plate 50.

The connection of top support 34 to connecting tab 32 of hook 22 holds the hook 22 in the proper orientation and facilitates alignment of hook 22 before, during and after a mounting operation. The use of rigid exterior plates 36 and interior plates 38 provide for improved control and alignment, whereas the use of a flexible top support 34 simplifies the design, reduces the weight of the design and allows or permits the rails of the ladder to rest directly on the cable when the hooks are engaged with the cable thereby providing a more stable and secure attachment. As such, each arrangement has its own advantages.

A bottom lever 58 is also connected to hook 22 adjacent the base 24. Bottom lever 58 is formed of any suitable size shape and design. In one arrangement, as is shown, bottom lever 58 is formed of an exterior plate 60 and an interior plate 62 which are positioned in parallel spaced relation to one another. The exterior plate 60 is positioned on the exterior side of hook 22, and the interior plate 62 is positioned on the interior side of hook 22. In this way, the parallel spaced positioning of exterior plate 60 and interior plate 62 sandwich or hold hook 22 there between. Exterior plate 60 and interior plate 62 extend a distance between a forward end 64 and a rearward end 66.

A third axle 68 extends through the exterior plate 60 and interior plate 62 adjacent the middle of bottom lever 58. Third axle 68 also extends through one or more spacers 53 and hook 22 adjacent base 24 thereby connecting hook 22 to exterior plate 60 and interior plate 62 while still allowing rotation of hook 22 between exterior plate 60 and interior plate 62. Spacers 53 are formed by one or more washers, bushings or other suitable devices.

A length of bottom lever 58 extends past the third axle 68 before terminating at forward end 64. This length of bottom lever 58 is long enough to cover all or a portion of the open interior of hook 22 defined by concave interior surface 30. In this way, when the rearward end 66 of bottom lever 58 is pulled down, this length of bottom lever 58 serves to lock a cable therein as is further described herein.

In one arrangement, the exterior surface of exterior plates 36, 60 engage or are positioned next to the interior surface of mounting tabs 54. To facilitate proper parallel spacing of exterior plates 36, 60 and interior plates 38, 62, a spacer 72 is positioned between the rearward end 42 of top support 34 and rearward end 64 of bottom lever 58. The second axle 46 and fourth axle 70 pass through these spacers 72 thereby holding them in place while simultaneously allowing rotation thereon. First, second, third and fourth axles 44, 46, 68, 70 are formed of any suitable device such as a conventional screw, bolt, rod or shaft. In one embodiment as shown in FIGS. 5-8 one or more spacers 72 are positioned adjacent forward end 64 of bottom lever 58 between interior plate 62 and exterior plate 60. One or more fasteners 71 such as bolts, rivets or other suitable devices secure spacer or spacers 72 in position adjacent forward end 64 of bottom lever 58.

To provide additional strength and rigidity, as well as to provide proper alignment and prevent deformation, interior plates 38, 62 have a flange 74 that extends the length of the interior plate 38, 62 and extends inwardly therefrom, such as in the form of a piece of angle-iron. Flange 74 extends transverse or perpendicular to the length interior plates 38, 62. Opposing flanges 74 of opposing sides of the system extend inwardly toward one another.

An attachment point 76 is connected to or positioned in the rearward end of the interior plate 62 of bottom lever 58. As one example, in the arrangement shown, attachment point 76 is a hole through the flange 74 of the interior plate 62 of bottom lever 58. However attachment point 76 can be any form of a device which is used to connect a user's safety harness to the bottom lever 58, such as through a D-ring, an O-ring or the like.

In order to ensure that the strand grabber consistently disengages properly from the cable, a spring bias 59 provides a downward rotational force or a downward pull on hook 22 either directly or through connected components such as bottom lever 58. In one arrangement, spring bias 59 is a spring that imparts a rotational force on bottom lever 58, the spring being placed around fourth axle 70 between the mounting tab 54 of the bottom mounting bracket 48 and the exterior plate 60 of the bottom lever 58. In this arrangement, the spring may be a torsion spring, a power spring, a clock spring, or any other type of spring that imparts a rotational force. In an alternative arrangement, spring bias 59 is formed of a shock cord, elastic cord, extension spring, or any other elastically stretchable device connected to the bottom lever 58 that provides a force that pulls the bottom lever 58 down. In one arrangement, this is accomplished by connecting the shock cord on one end to the side rail 12 and on the opposite end to the bottom lever 58 such that the shock cord stretches when the hook 22 grabs a strand and the bottom lever 58 rotates forward. In this way, spring bias 59 thereby exerts a downward force on both the bottom lever 58 and hook 22. Alternately, disengagement of the strand grabber from the cable may be accomplished purely through the force of gravity.

In order to ensure that the strand grabber 20 remains in the fully disengaged position when it is not in use a magnetic catch or other latch may be used to secure the strand grabber 20 in the fully disengaged position. In one arrangement, a magnet 23 is incorporated into hook 22 in a position that results in the magnet 23 coming near or engaging axle 70 and spacer 72 when hook 22 is in a fully disengaged position. In this arrangement, axle 70 and spacer 72 are made of ferrous materials resulting in magnet 23 magnetically securing hook 22 to axle 70 and/or spacer 72 when strand grabber is not in use. Alternately, magnet and ferrous material could be located in any position that would result in strand grabber 20 being secured when not in use. Any other suitable latch mechanisms could also be used to secure the strand grabber when not in use.

In Operation: Two fixed strand grabbers 20 are connected to a ladder 10. To do so, the mounting plates 50 of mounting brackets 48 are attached to the interior surface of side rails 12 at the desired position on the ladder 10. In one arrangement the mounting plate 50 connected to the top support 34 is positioned above and rearward from the mounting plate 50 connected to the bottom lever 58. In this arrangement, in the example shown, proper spacing is accomplished when the lower forward corner of the top mounting plate 50 is aligned with and adjacent to the upper rearward corner of the bottom mounting plate 50. Once in proper alignment, conventional fasteners 52 are passed through mounting holes of mounting plate 50 thereby connecting the mounting plates 50 to side rails 12. In an alternative arrangement, a single mounting plate that includes mounting tabs 54 for top support 34 and bottom lever 58 on the same mounting plate thereby ensuring proper spacing and eliminating a part from the assembly.

Once fixed stand grabbers are installed on each side rail 12, the ladder 10 is ready for use on a stretched cable 78. To do so, the user lifts the portion of the ladder 10 having the fixed strand grabbers 20 thereon past the height of the cable 78. Once the hooks 22 of the fixed strand grabbers 20 are above the cable 78, the user leans the forward side of the ladder against the cable 78. In doing so, weight of the ladder 10 is transferred to the cable 78.

Figure 3:
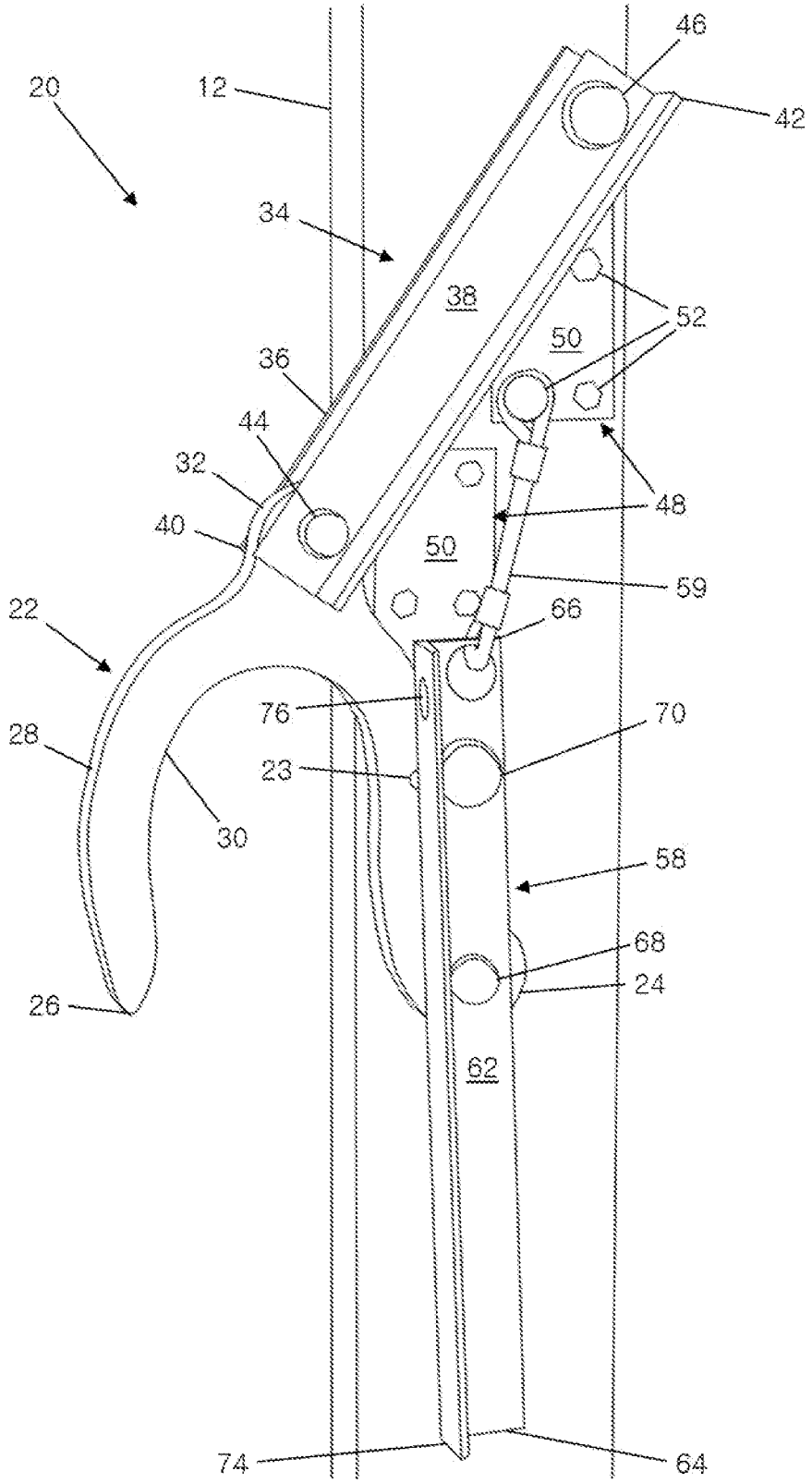
FIG. 3 is a side perspective view of one side of a fixed strand grabber attached to a ladder, the view showing the fixed strand grabber in a disengaged position.
Figure 4:
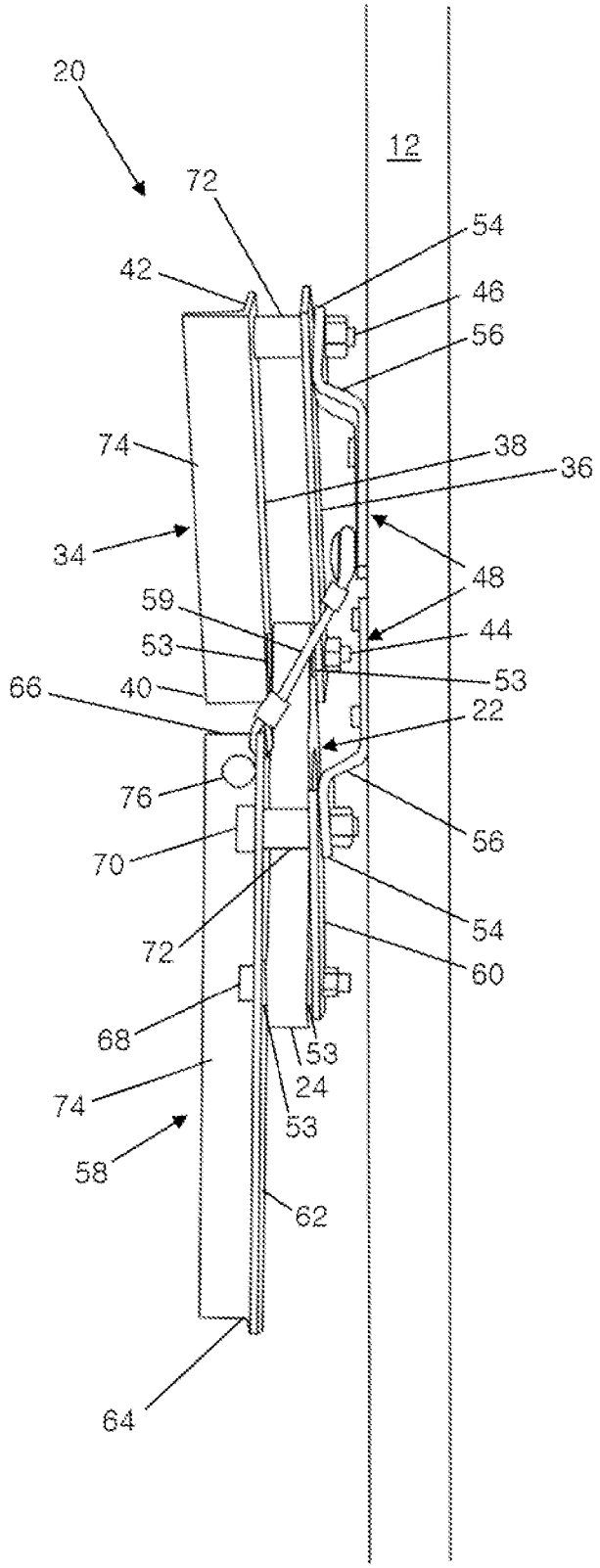
FIG. 4 is a rear perspective view of one side of a fixed strand grabber attached to a ladder shown in FIG. 3, the view showing the fixed strand grabber in a disengaged position.
Figure 5:
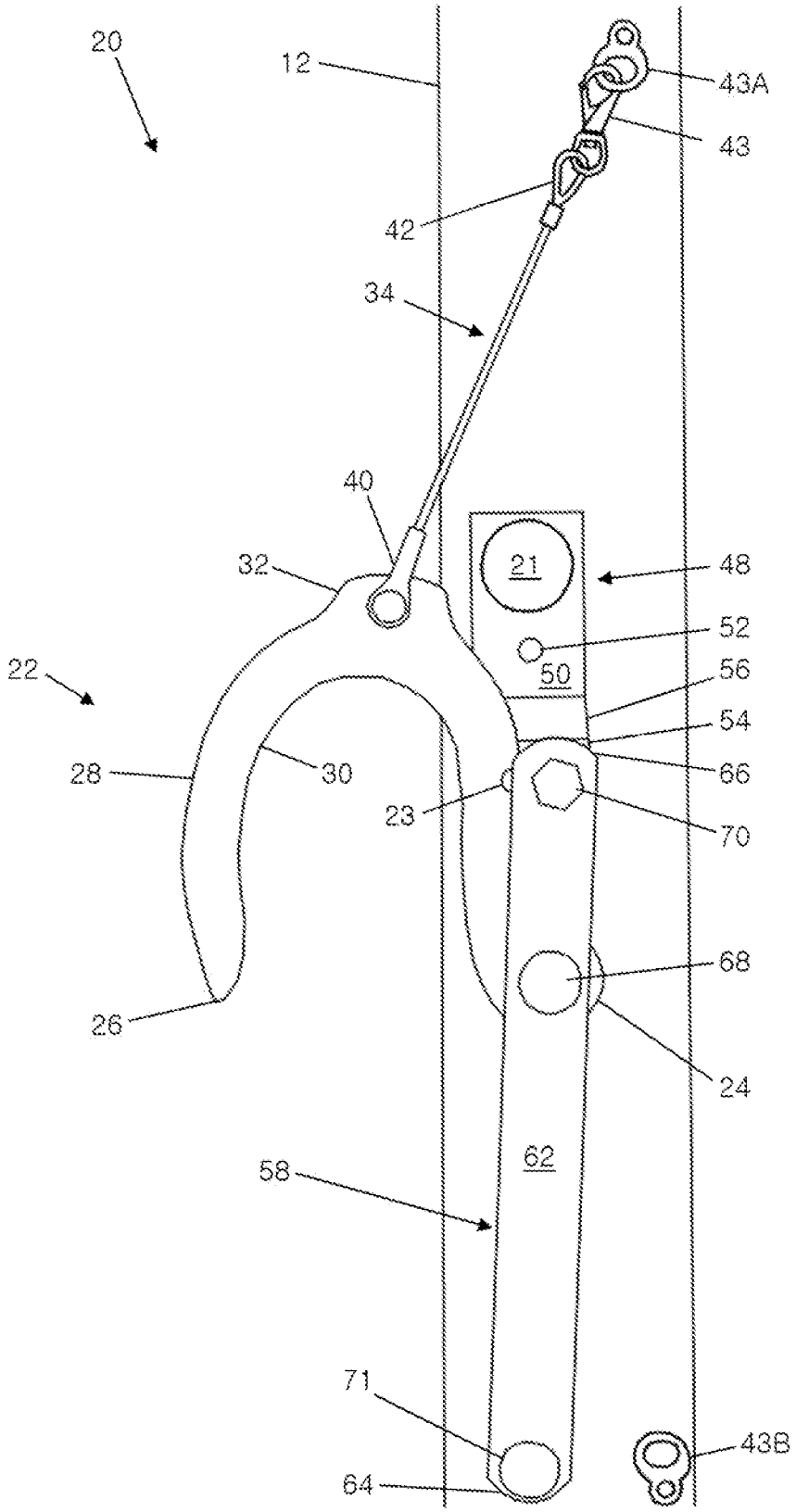
FIG. 5 is a side elevation view of one side of a fixed strand grabber attached to a ladder, the view showing the fixed strand grabber in a disengaged position, the view also showing a flexible top support, a rear stop and a magnetic connector.
Figure 6:
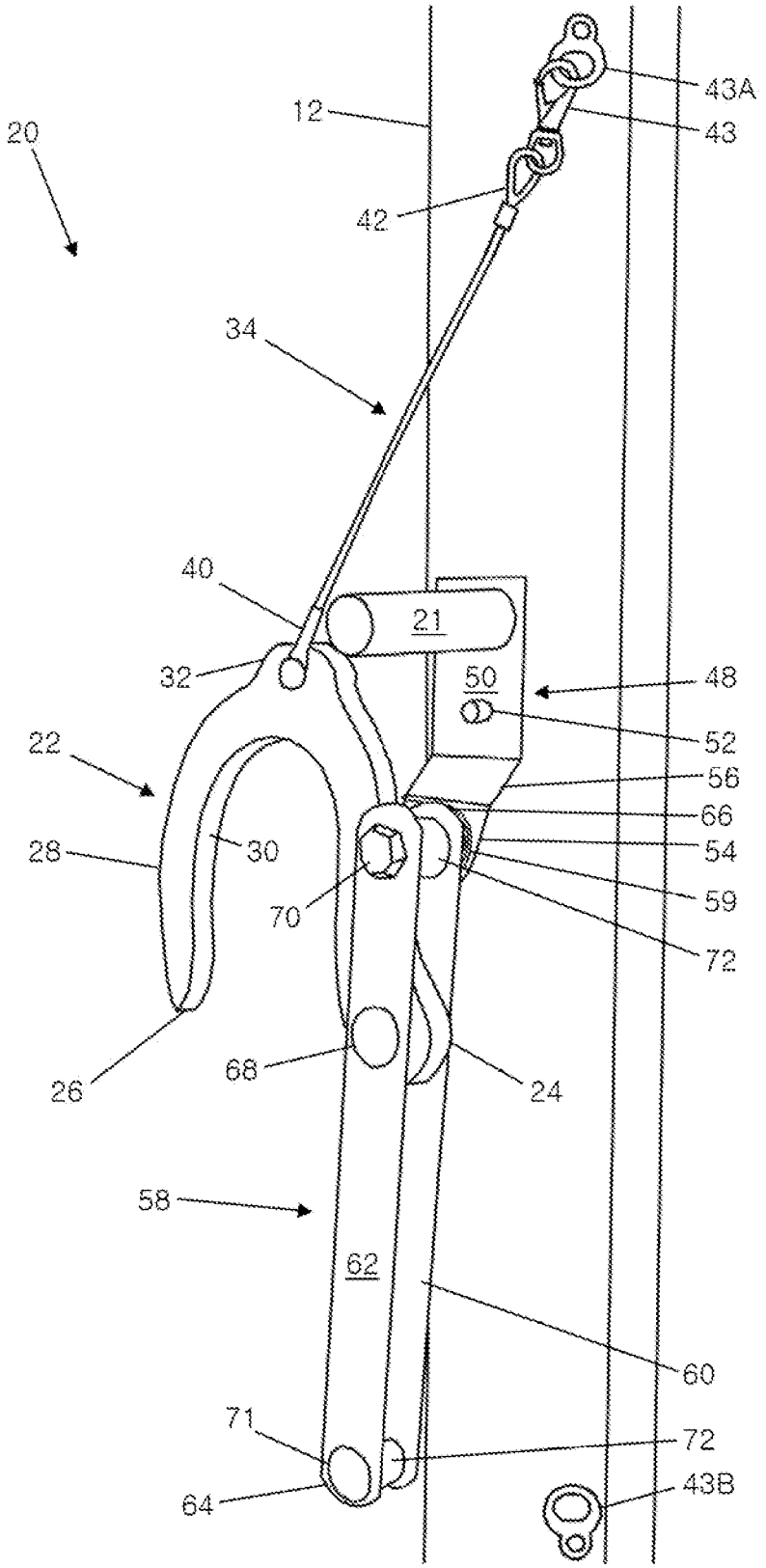
FIG. 6 is a side perspective view of the device shown in FIG. 5, the view showing the stop protruding from the ladder and the spring.
Figure 7:
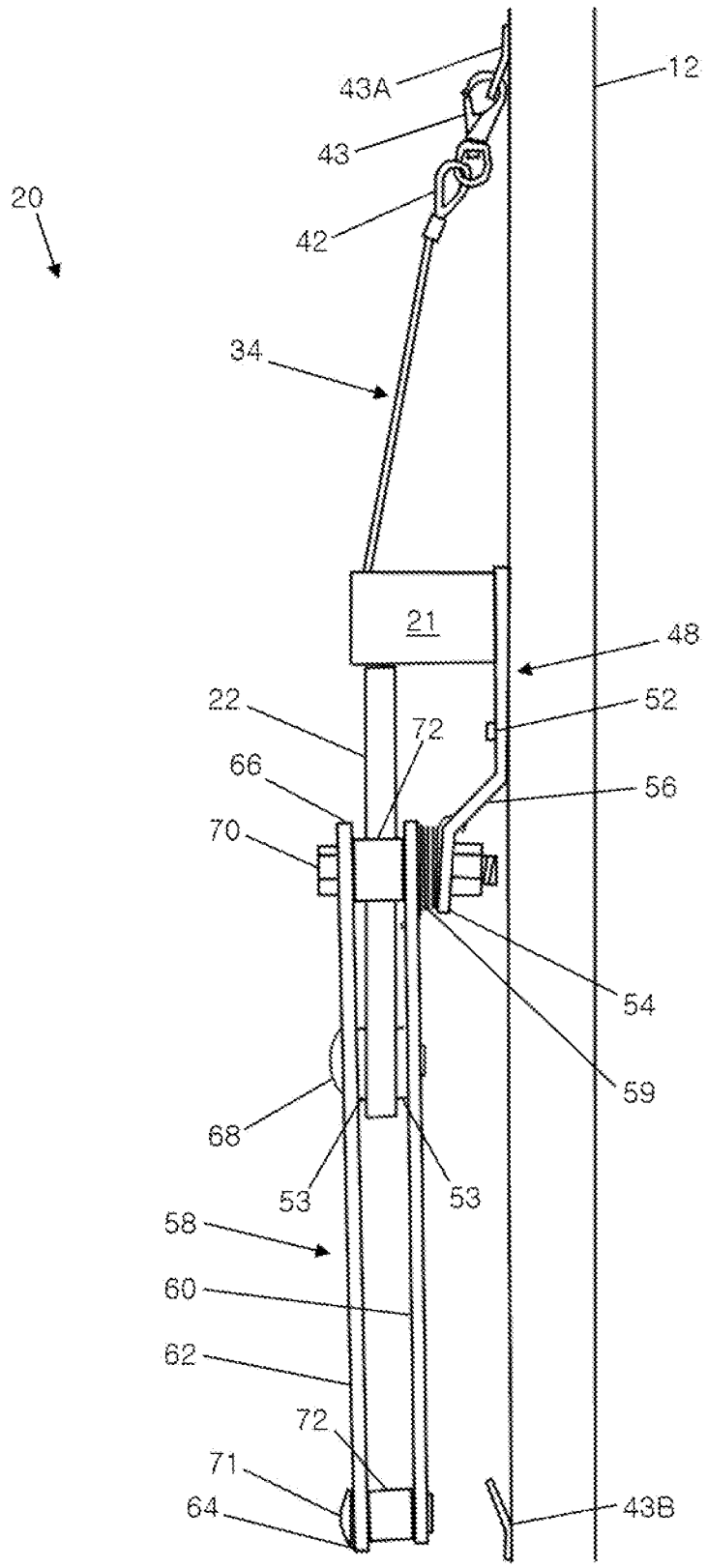
FIG. 7 is a rear elevation view of the device shown in FIG. 5, the view showing the stop protruding from the ladder and the spring.
Figure 8:
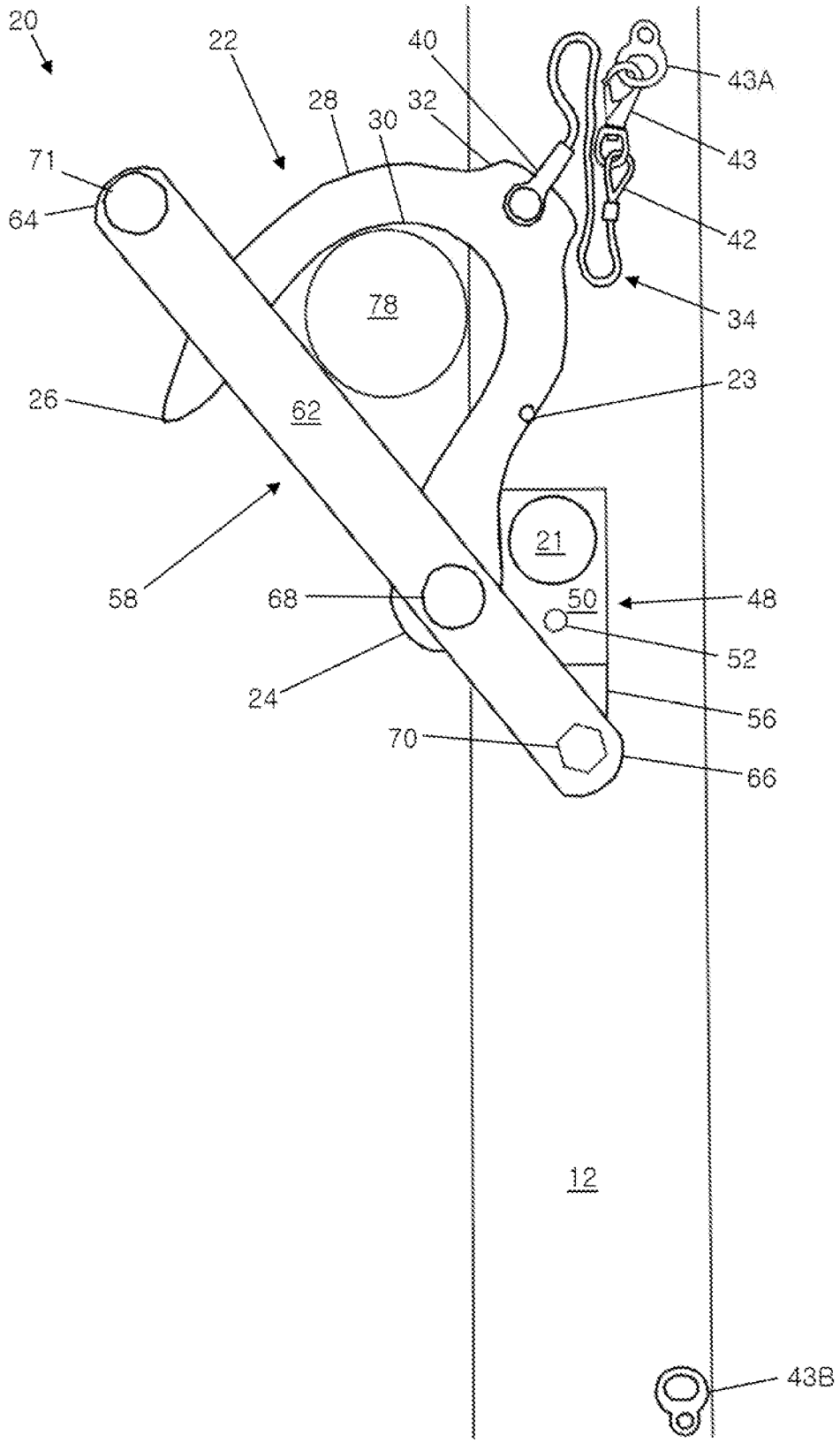
FIG. 8 is a side elevation view of the device shown in FIG. 5, the view showing the device in an engaged position.

Next, the user lowers the ladder 10 while it leans upon the cable 78. In doing so, the fixed strand grabbers 20 transition from a fully disengaged position, as is shown in FIGS. 3, 5 and 6 to a fully engaged position, as is shown in FIG. 8.

That is, as the ladder 10 is lowered the rails 12 slide upon the cable 78. Because the tip 26 of hooks 22 extend outwardly from the forward side of ladder 10, as the ladder is lowered the cable 78 is captured within the open interior of hooks 22 defined by the concave interior surface 30.

Once the cable 78 is captured within the open interior of hooks 22, and the ladder 10 continues to be lowered, weight is transferred to hooks 22. This causes hooks 22 to move upward and causes the top support 34 and bottom lever 58 to rotate upward as well.

As the bottom lever 58 rotates, the forward end 64 rotates towards and past the tip 26 of hook 22. In this way, the forward end 64 of bottom lever 58 closes the open interior of hook 22 thereby capturing the cable 78 therein and preventing unintentional disengagement.

One advantage of this arrangement is that as more weight is placed on the system, the firmer the hold on the cable 78 is. That is, the more weight placed on the ladder, the less likely the ladder 10 is to slip off the cable 78.

Another advantage of this arrangement is the position of the attachment point 76. Because the attachment point 76 is opposite the forward end 64 of the bottom lever 58, in the event that a user were to slip and fall while clipped into the attachment point by a conventional harness, the weight of the tailing user on the rearward end 66 of the bottom lever 58 further ensures that the cable 78 will not slip out of between hooks 22 and bottom levers 58. To provide additional assurance that the fixed strand grabber 20 does not slip on the cable 78, a textured surface or anti-slip coating is placed on the bottom levers 58 and/or the hooks 22 adjacent to where these components 58, 22 engage cable 78. Alternatively, a compressible layer, such as a layer of rubber or the like material is positioned on these surfaces.

Another advantage of this arrangement is that the two fixed strand grabbers 20 connected to the ladder 10 operate independently of one another. That is, because the two books 20 are not directly connected to one another this allows each hook 22 to function independent of one another. This is beneficial when the cable 78 is not perpendicular to the ladder 10 and allows for a more stable connection in this situation.

In an alternative arrangement, instead of two mounting brackets 48, one for the top support 34 and one for the bottom lever 58, a single mounting bracket 48 facilitates connection of both the top support 34 and bottom lever 58. In yet another alternative embodiment, top support 34 and bottom lever 58 are connected directly to the side rails 12 of ladder 10.

After use, the spring bias 59, either a spring or a stretchable device, helps to return the system back to a disengaged position by imparting a rotational force on the bottom lever 58. Once the spring bias 59 returns the bottom lever 58 to the disengaged position magnetic catch 23 magnetically engages fourth axle 70, spacer 72 or any other component of the system, thereby holding the system in a disengaged position. This allows a user to easily remove the ladder 10 from the cable 78 without unintentional interference.

Figure 2:
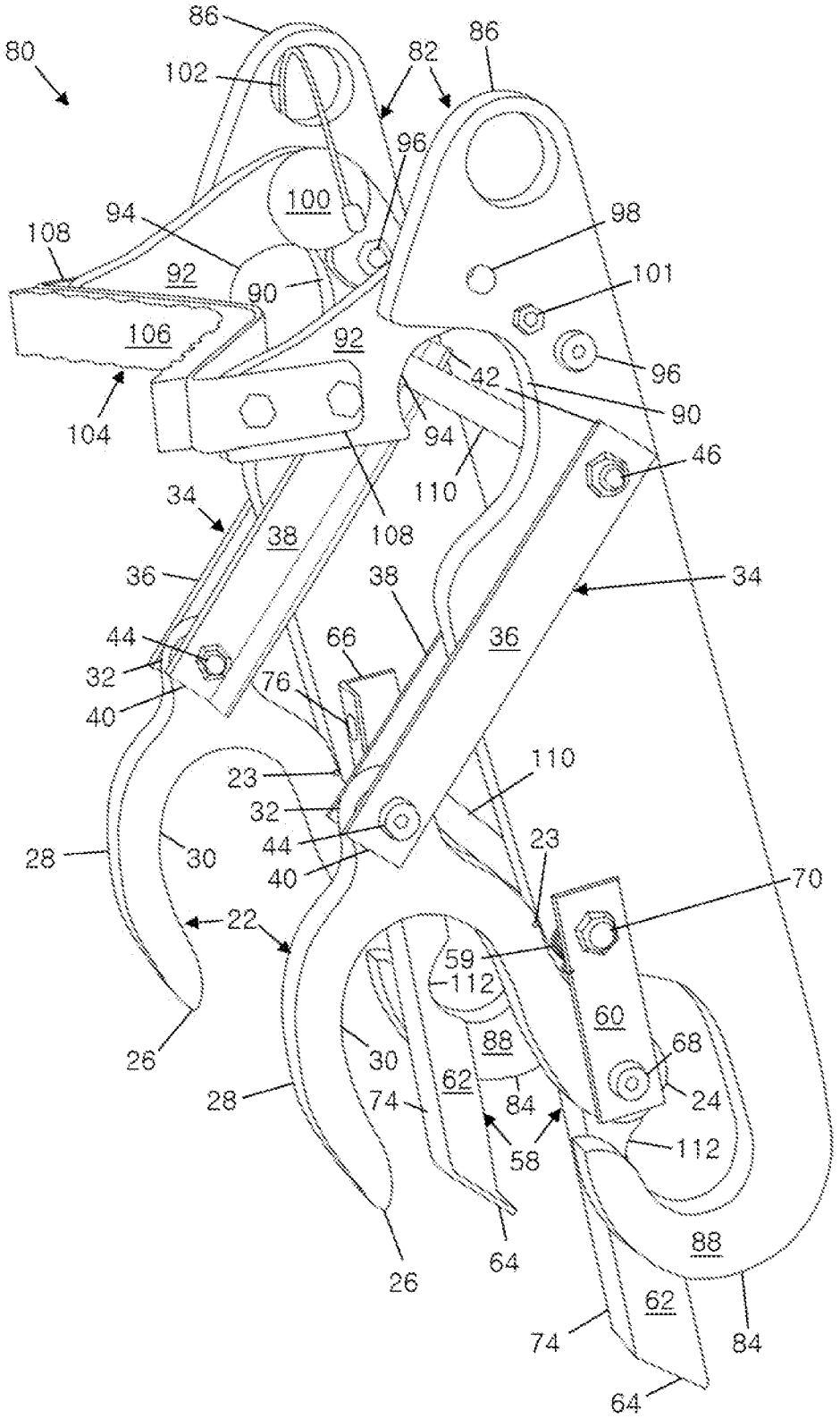
FIG. 2 is a perspective view of the removable strand grabber of FIG. 1, the removable strand grabber removed from the ladder and positioned in a disengaged position not on a cable.
Figure 9:
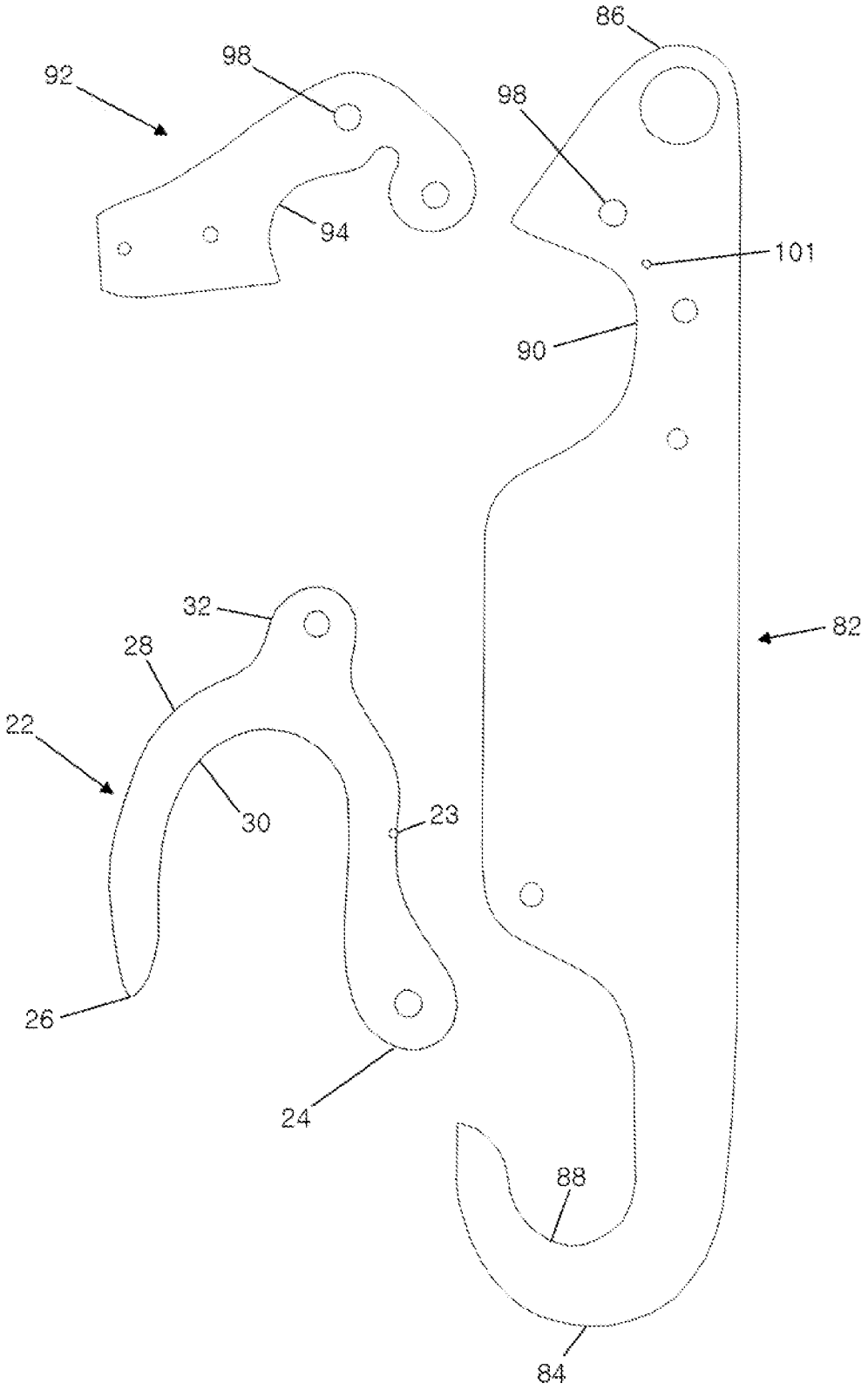
FIG. 9 is a side elevation exploded view of the cradle sides, hooks and rung latch of a removable strand grabber.

Removable Strand Grabber: With reference to FIGS. 1-2 as well as the exploded view in FIG. 9, a removable strand grabber 80 is presented. The removable strand grabber 80 operates in a similar fashion, and provides similar advantages, as the fixed strand grabber 20 with the added advantage that the removable strand grabber 80 is connected to ladder 10 in a removable fashion. The removable strand grabber 80 can be installed or removed in only a few seconds.

Removable strand grabber 80 is formed of any suitable size, shape and design. As one example, as is shown, removable strand grabber 80 has a pair of cradle sides 82. Cradle sides 82 are generally planar in shape and extend from a bottom end 84 to a top end 86.

A rung hook 88 is positioned in the cradle sides 82 adjacent bottom end 84. Rung hook 88 is formed of any suitable size, shape and design so as to receive and hold on to rungs 18 of ladder 10. Rung hooks 88 open toward the forward side of removable strand grabber 80. In the arrangement shown, when in place, rung hook 88 partially wraps around rung 18 of ladder 10.

A rung notch 90 is positioned in the cradle sides 82 adjacent top end 86. Rung notch 90 is formed of any suitable size, shape and design so as to receive rungs 18 of ladder 10 therein. Unlike rung hook 88, rung notch 90 does not wrap around rungs 18 of ladder 10.

A rung latch 92 is positioned adjacent to each rung notch 90. Rung latch 92 is formed of any suitable size, shape and design. In the arrangement shown, as an example, rung latch 92 is formed of a hook shaped member or a partially hook shaped member having a concave interior surface 94 that, when in position, wraps around the upper portion of rung 18 and thereby locks rung 18 between rung latch 92 and rung notch 90. Rung latch 92 is positioned on the inward side of cradle sides 82 and is connected by a fifth axle 96. Alternately, rung latch 92 may be positioned on the outward side of cradle sides 82 or alternately may be positioned in a slot or recess within cradle sides 82. Fifth axle 96 extends through rung latch 92 adjacent its rearward lower end and also extends through cradle side 82 at or adjacent the middle of rung notch 90. Fifth axle 96 provides the pivot point for rotation of rung latch 92 onto and around rungs 18 of ladder 10.

In one arrangement, to lessen the weight, and material costs, of cradle sides 82, cradle sides 82 are skeletonized. That is, the material in the center of cradle sides 82 is removed as is allowed without affecting the function or structural rigidity of the cradle sides 82.

When rung latches 92 are in position over a rung 18, a through hole 98 in rung latch 92 and cradle sides 82 are in alignment with one another. When in this position, a locking pin 100 is inserted through the rung latch 92 and the cradle side 82 thereby securely locking the removable strand grabber 80 in place over and across a pair of rungs 18. A safety wire 102 connects locking pin 100 to cradle side 82 so as to prevent the locking pin 100 from being lost when not in use. In addition, a latch stop 101 is connected to the cradle sides 82 adjacent the rung notches 90. Latch stops 101 extend inward from the cradle sides 82 and serve as a forward most stop for rung latches 92 and prevent them from over rotating.

A V-brace 104 is connected to and extends across between opposing rung latches 92. V-brace 104 is connected to the forward end of rung latches 92 and angles rearward therefrom to form a V-shaped member which is used for leaning ladder 10 against a utility pole. A compressible or gripping member 106, such as a layer of textured rubber or the like, is positioned on the forward side of V-brace 104 to help hold onto a utility pole when in use. In the arrangement shown, V-brace 104 has arms 108 which extend down in parallel spaced relation along a side of rung latch and are bolted thereto. The connection of V-brace 104 across the opposing rung latches 92 allows a user to engage both rung latches 92 by simply actuating or moving the V-brace 104. In this way, V-brace 104 saves a user time when installing the removable strand grabber 80 onto a ladder 10. This arrangement also provides additional strength and rigidity to the arrangement and ensures that neither rung latch 92 becomes unintentionally disengaged.

The hook 22, top support 34, bottom lever 58, spring 59 and magnetic catch 23 arrangement taught herein with respect to the fixed strand grabber 20 is similarly applied to the removable strand grabber 80. One difference is that the axles 44, 46, 68, 70, 96 may extend the entire distance between the opposing cradle sides 82. In the arrangement shown, the second axle 46 and the fourth axle 70 extend across and between the cradle sides 82. Or alternatively support rods 110 are used that extend this distance and allow for connection as well as rotation. This provides additional strength and rigidity to the removable strand grabber 80 as well as helping to maintain proper spacing and alignment of the cradle sides 82.

Another difference is that the interior plate 62 of the bottom levers 58 includes a rung recess 112 in its rearward or bottom side. Rung recess 112 is sized and shaped to receive a rung when the removable strand grabber 80 is in a disengaged position. This rung recess 112 allows bottom lever 58 to lay flat or in a more-flat position over rungs 18 thereby preventing the bottom lever 58 from being a safety hazard and further improving the ease of use of the system. Also, the forward end 64 of bottom lever 58 is angled or curved so as to also avoid protruding when in a disengaged position. By not protruding, this allows the removable strand grabber 80 to be used in association with extendable ladders which include components that slide over one another without interfering with this sliding functionality.

In Operation: A removable strand grabber 80 is installed on a ladder 10 by aligning the cradle sides 82 along the interior sides of side rails 12 of ladder 10. When in this position, the rung hooks 88 are looped over or around a bottom of two selected rungs 18. Next, the cradle sides 82 are rotated forward such that the upper of the two selected rungs 18 fit within the rung notch 90. Next, when in this position, the rung latches 92 are rotated into position over the top side of this rung. The rung latches 92 are rotated into position simultaneously by actuation of the V-brace 104. When fully engaged, the concave interior surface 94 of rung latches 92 engages the rungs 18 and the through hole 98 in the cradle sides 82 aligns with the through hole 98 in the rung latch 92. Once the through holes 98 are aligned the locking pin 100 is inserted there through and is held in place by a cotter pin or other locking mechanism that prevents unintentional withdrawal. In this position, the removable strand grabber 80 is installed on ladder 10. In this position the rung hook 88 is held in tension over the bottom rung 18 while the rung notch 90 and rung latch 92 is held in tension over the upper rung 18 thereby providing a strong and tight engagement.

One advantage of this arrangement that should not be overlooked is that the strand grabber, removable and non-removable, can be attached to any portion of a ladder 10. Research shows that many mid-span ladder falls are a result of the user extending the ladder 10 above the cable 78 so that the hooks 22 were not fully engaged over the cable 78. This is due in large part to the fact that the ladder 10 that was used was not well suited to the particular application, or the particular height of cable 78. Or said another way, the strand grabber was not positioned in the appropriate place on ladder 10 for the particular application. By providing the user with a system that can be placed on any position of a ladder 10 this problem is alleviated. This ensures that each user has a strand grabber positioned at the optimum and safest position on the ladder 10 thereby significantly improving the user's safety.

From the above discussion it will be appreciated that the cable hook ladder attachment presented provides and offers many advantages over the prior art. Specifically, the cable hook ladder attachment shown and described herein improves upon the state of the art, is inexpensive, improves safety of using a ladder on a cable, has a minimum number of parts, has an intuitive design, is safer to operate than prior devices because it does not get in the user's way when in operation, provides an permanently attachable solution as well as a removable solution, is efficient to use, is rugged and durable, is easy to use, is light weight, has hooks that are independently engaged, among countless other desirable features and functions.

It will be appreciated by those skilled in the art that other various modifications could be made to the device without parting from the spirit and scope of this invention. All such modifications and changes fall within the scope of the claims and are intended to be covered thereby.

What is claimed:

1. A strand grabber attachment for a ladder comprising:

a flexible top support extending between a forward end and a rearward end of the top support;

the top support connected adjacent its rearward end to the ladder;

the top support connected adjacent its forward end to a hook having an open interior;

a bottom lever extending between a forward end and a rearward end of the bottom lever;

the bottom lever connected adjacent its rearward end to the ladder;

the bottom lever connected by a connection point positioned between its rearward end and its forward end to the hook; and wherein the hook is configured to transition from a disengaged position to an engaged position when lowered over a cable such that the cable is captured in the open interior of the hook and pinned in place by a portion of the bottom lever thereby preventing unintentional escape of the cable from the hook when in use.

2. The ladder attachment of claim 1 wherein the rearward end of the top support is connected to a mounting bracket which is connected to the ladder.

3. The ladder attachment of claim 1 wherein the rearward end of the bottom lever is connected to a mounting bracket which is connected to the ladder.

4. The ladder attachment of claim 1 wherein the forward end of the top support is connected adjacent an upper portion of the hook.

5. The ladder attachment of claim 1 wherein the bottom lever is connected adjacent a bottom portion of the hook.

6. The ladder attachment of claim 1 wherein the bottom lever has an interior plate and an exterior plate with a portion of the hook positioned therebetween.

7. The ladder attachment of claim 1 wherein at least a portion of the bottom lever extends a distance beyond the connection point such that when transitioning from a disengaged position to an engaged position, the bottom lever closes the open interior of the hook.

8. A strand grabber attachment comprising:

a bottom lever extending a length between a forward end and a rearward end of the bottom lever;

a flexible top support extending a length between a forward end and a rearward end of the top support;

a hook extending between a base and a tip, the hook having a curved interior;

the bottom lever pivotally connected to a ladder adjacent its rearward end and pivotally connected to the hook adjacent a midpoint between its rearward end and its forward end;

the top support connected to the ladder adjacent its rearward end and connected to the hook adjacent its forward end;

wherein the hook transitions between a disengaged position and an engaged position, such that in the disengaged position the curved interior of the hook is unobstructed and in an engaged position a portion of the bottom lever covers a portion of the curved interior.

9. The strand grabber of claim 8 wherein the top support connects to the ladder by a clip.

10. The strand grabber of claim 8 further comprising a back stop connected to the ladder, the back stop positioned rearward of the hook thereby preventing rearward rotation of the hook.

11. The strand grabber of claim 8 further comprising a magnetic member connected to the hook, wherein the magnetic member magnetically connects to a component of the strand grabber attachment in the disengaged position, thereby holding the hook in the disengaged position.

12. The strand grabber of claim 8 further comprising a spring bias connected to the bottom lever, wherein the spring provides a rotational force on the hook that moves the hook to a disengaged position.

13. The strand grabber of claim 8 further comprising a spring bias connected to the bottom lever, wherein the spring provides a rotational force on the hook that moves the hook to a disengaged position, wherein the spring bias is formed of a torsion spring.

14. The strand grabber of claim 8 further comprising a spring bias connected to the bottom lever, wherein the spring provides a rotational force on the hook that moves the hook to a disengaged position, wherein the spring bias is formed of an elastic member.

* * * * *